United States Patent [19]

Pruden et al.

[11] Patent Number: 4,694,612

[45] Date of Patent: Sep. 22, 1987

[54] WOOD-CLAD ALUMINUM WINDOW FRAME AND ASSOCIATED WINDOW ASSEMBLY

[75] Inventors: Charles W. Pruden; Alfred P. McEvoy; Charles S. McEvoy, all of Dallas, Tex.

[73] Assignee: Western Extrusions Corporation, Carrollton, Tex.

[21] Appl. No.: 916,839

[22] Filed: Oct. 9, 1986

[51] Int. Cl.[4] ..... E05F 1/00

[52] U.S. Cl. ..... 49/445; 49/504

[58] Field of Search ..... 49/445, 501, 504, 63

[56] References Cited

U.S. PATENT DOCUMENTS

| | | | |
|---|---|---|---|
| 3,280,889 | 10/1966 | Wahfeld et al. | 49/63 X |
| 4,324,071 | 4/1982 | Ishida | 49/63 |
| 4,328,644 | 5/1982 | Scott et al. | 49/501 |
| 4,583,639 | 4/1986 | Fedick et al. | 49/445 X |

OTHER PUBLICATIONS

Peachtree sales brochure entitled "Ariel Wood Casement and Awning Windows, The Windows to the Future" (1984).

Wenco sales brochure entitled "JX-7 Clad Double-Hung Windows" (1984).

*Primary Examiner*—Kenneth Downey

*Attorney, Agent, or Firm*—Hubbard, Thurman, Turner & Tucker

[57] ABSTRACT

A wood-clad metal window frame is formed from four extruded aluminum sections to each of which is secured at its interior side edge a wood facing member. Each of the extrusions has formed thereon various lips and flanges which collectively define in the assembled frame an integral J-channel, an integral nailing and flashing flange, and a pair of integral jamb channels each adapted to receive and retain a conventional sash-supporting balance member. Carried within the frame, and concealing an interior portion of the head section of the frame is a sight baffle which has integrally formed therewith a weather stripping element positioned to sealingly engage a window sash installed in the frame. The wood facing members collectively define in the assembled frame an interior wood border which provides the frame with an all-wood interior appearance and further functions as a thermal damper to inhibit outward and inward heat flow through the frame. When the extruded aluminum frame is hung with conventional wood window sashes, the resulting frame-and-sash assembly has the desirable interior appearance of an all-wood frame and sash assembly, but may be fabricated and completely assembled at a fraction of the cost thereof.

31 Claims, 6 Drawing Figures

WOOD-CLAD ALUMINUM WINDOW FRAME AND ASSOCIATED WINDOW ASSEMBLY

BACKGROUND OF THE INVENTION

The present invention relates generally to window frame construction, and more particularly provides a uniquely configured and constructed wood-clad extruded aluminum window frame which is adapted to receive a wide variety of standard wood window sashes. When hung with wood window sashes and installed in a pre-formed window opening in a wall, the frame provides the frame-and-window assembly with a very desirable "all wood" interior appearance-despite the fact that a metal frame is utilized-while at the same time presenting at the exterior of the wall an extremely durable and weather-resistant aluminum frame surface around the entire periphery of the window.

Conventional all-wood frame and window assemblies are typically "shop" constructed and later delivered to a construction site for installation in a wall's pre-formed window opening. The typical "shop" window has more than twenty individual pieces and usually takes at least half an hour to build, thus making this type of assembly relatively costly to fabricate.

Additionally, when the shop-constructed window assembly is delivered to the construction site, a considerable amount of on-site labor is required to properly install and seal the window assembly within the wall opening, thereby further increasing its cost. For example, a flashing system (which exteriorly seals the window assembly) must be fabricated and installed around the window frame at its juncture with the window opening. Moreover, other structural elements, such as J-channels, brick molds and drip cap headers must be constructed and installed to complete the window installation.

As is well known, the exterior surface of such "shop" window assembly's all-wood frame (like the exterior surfaces of its wood window sashes) is quite susceptible to deterioration caused by heat, cold and dampness. To retard such deterioration, it has become a common practice to clad the exterior surfaces of such all-wood assembly with aluminum or vinyl. This additional cladding step, of course, increasess the already relatively high fabrication and installation cost of the all-wood window assembly.

These problems associated with all-wood window construction may be overcome to a certain extent by the use of an all-aluminum frame-and-sash window assembly, such all-aluminum (or other metal) construction being conventionally cheaper to fabricate and install. However, this alternate construction is not without its own limitations and disadvantages. For example, since aluminum has a significantly higher coefficient of thermal conductivity (or "U" value) than wood, the winter heat loss and summer heat gain is concomitantly increased relative to wood construction window assembly.

Additionally, particularly in office and residential structures, the interior appearance of such all-metal window assemblies is simply not as aesthetically pleasing as its wood counterpart. Simply stated, they exude to the room neither the warmth nor the luxury typically associated with wood surfaces.

From the foregoing it can be seen that it would be desirable to provide an aluminum frame construction window assembly which provides the aesthetically pleasing interior appearance, and at least some of the other desirable features, of all-wood window construction, while eliminating or reducing above-mentioned and other problems and limitations associated with all-wood window construction.

Accordingly, it is an object of the present invention to provide such as assembly to meet these desirable objectives.

SUMMARY OF THE INVENTION

In carrying out principles of the present invention, in accordance with a preferred embodiment thereof, a uniquely configured wood-clad metal window frame is provided which, when hung with conventional wood window sashes, provides the completed frame-and-sash assembly with a very pleasing "all wood" interior appearance at a fraction of the cost of a conventional all-wood "shop" window assembly.

The frame is preferably constructed from four extruded aluminum sections which have integrally formed thereon flange and lip means that collectively define in the assembled frame an integral J-channel extending around the exterior side periphery of the frame, an integral, outwardly projecting nailing and flashing flange extending around the exterior side periphery of the frame, and an integral pair of jamb channels each adapted to receive and retain a sash-supporting balance member. Each of the extruded aluminum sections has secured thereto a wooden facing member, the facing members collectively defining in the assembled frame an interior wood border which provides the frame with an all-wood interior appearance, and further functions to inhibit inward and outward heat flow through the frame.

According to another feature of the present invention, the lip and flange means further define an interior channel which receives sight baffle means that function to conceal an interior head portion of the frame immediately behind the wood facing border thereon. Formed integrally with such sight baffle means is a weather stripping element which operatively engages and seals a window sash element installed in the frame.

The flange and lip means also form means for carrying various weather stripping elements within the frame. With the sight baffle, balance sections, weather stripping elements, and wood facing members secured to appropriate ones of the extruded aluminum sections, the sections may conveniently be inventoried and later collected to form assembly kits for delivery to a distributor assembly location where the aluminum sections may be quickly and easily joined to form a completed window frame.

DETAILED DESCRIPTION

Figure 1:
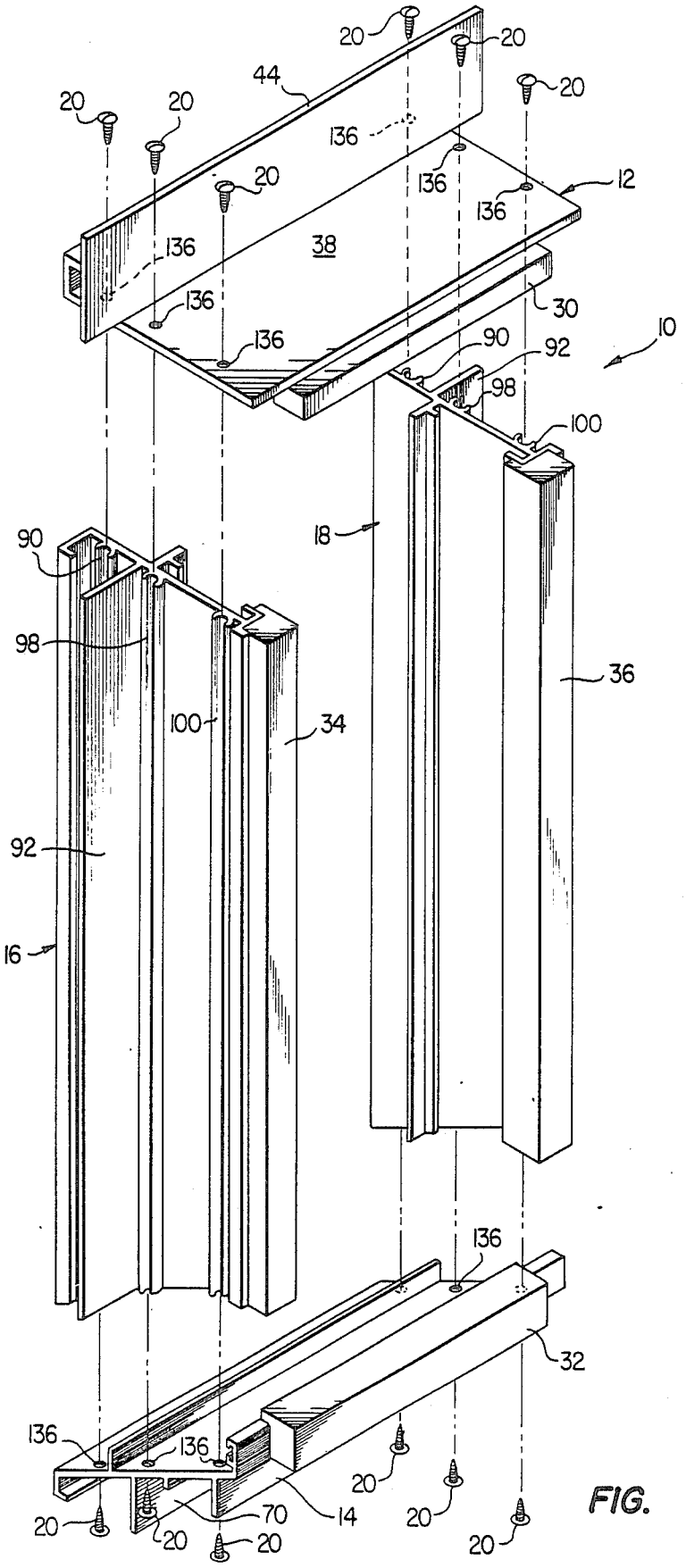
FIG. 1 is an exploded perspective view of a wood-clad extruded aluminum window frame which embodies principles of the present invention.

Illustrated in exploded perspective in FIG. 1 is a wood-clad aluminum window frame 10 which embodies principles of the present invention. Frame 10, whose interior and exterior sides, respectively, face downwardly to the right and upwardly to the left in FIG. 1, comprises four extruded aluminum sections-an upper or head section 12, a lower or sill section 14, and a pair of vertically extending side or jamb sections 16 and 18. These four sections (which carry other simple frame components subsequently described) are very easily and rapidly intersecured to form the frame 10 by means of twelve ordinary sheet metal screws 20 positioned in sets of three at each corner of the frame. It is important to note that the installation of these twelve screws is all that is required to completely assemble the frame.

Figure 2:
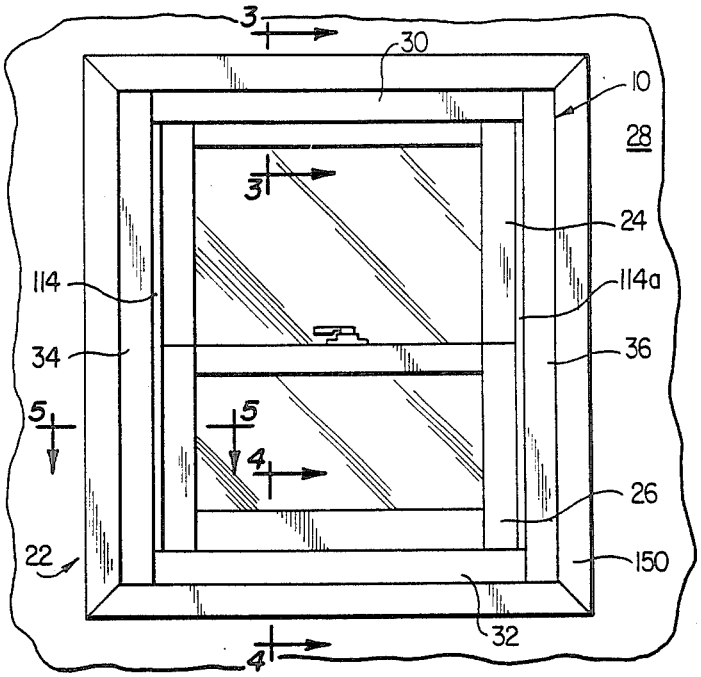
FIG. 2 is an interior elevational view of a window assembly which incorporates the frame and is installed in a pre-formed window opening in a representative frame construction wall.

The assembled frame 10 is incorporated into a window assembly 22 (FIG. 2) which is formed by the insertion into the frame, in a manner subsequently described, of conventional upper and lower wood window sashes 24 and 26. Assembly 22 is received within a suitable pre-formed window opening extending through a representative frame construction wall 28, FIG. 2 depicting an interior elevational view of the assembly 22 and wall 28.

Before describing in more detail the structure of frame 10 and assembly 22, certain important aspects thereof should be noted. First, the total assembly time required to completely construct the assembly 22, including the installation in the Frame 10 of the sashes 24 and 26, is only approximately five minutes. This, of course, represents a very significant cost savings compared to "shop" constructed all-wood window assemblies which typically take at least thirty minutes to assemble.

Secondly, compared to the conventional all-wood window assembly which typically has at least twenty separate pieces which must be interconnected, the assembly 22 has only 6 primary elements-the four exterior aluminum frame sections and the two window sashes.

Due to a unique incorporation into the four frame sections of interior wood facing members 30, 32, 34 and 36, the window assembly 22, when viewed from the interior side thereof, gives the desirable appearance-at a fraction of the cost thereof-of a conventional all-wood frame and window assembly.

Referring now to FIGS. 3–6, the configurations of the extruded aluminum frame sections 12, 14, 16 and 18 will be described in detail. The head section 12 has, as cross-sectionally viewed in FIG. 3, a horizontally extending base portion 38 having at its left or exterior side edge a generally J-shaped portion 40. Also formed on the base portion 38, in leftto-right sequence from the edge portion 40, are: a short, downwardly projecting flange 42; a much longer, upwardly projecting nailing flange portion 44; a downwardly projecting flange 46 having formed on its lower end a generally C-shaped portion 48 which receives and retains along its length a strip 50 of flexible weather stripping; and a spaced pair of short, downwardly projecting flanges 52 and 54 which have barbed lower ends and are positioned leftwardly of the right or interior side edge of base portion 38. These barbed lower end portions engage and retain upwardly extending, similarly barbed projections 56, 58 on a vinyl sight baffle member 59 which extends along the length of section 12 and has a flexible weather stripping portion 60 that projects leftwardly of flange 52. The elongated wood facing member 30 which, like the other three wood facing members has a generally square cross-section, has an upper left corner portion which engages the flange 54 and a right end portion of base 38, projects slightly rightwardly therefrom, and has formed along its lower side a leftwardly projecting lip 62. Wood facing member 30 is fastened to the extruded aluminum head section 12 by means of staples 64 which extend downwardly through the right end of the base portion 38. As can best be seen in FIG. 1, the nailing flange portion 44 is somewhat longer than the balance of extruded section 12, and projects longitudinally outwardly from its opposite ends. Wood facing member 30 is somewhat shorter than section 12 and is longitudinally centered thereon.

Figure 4:
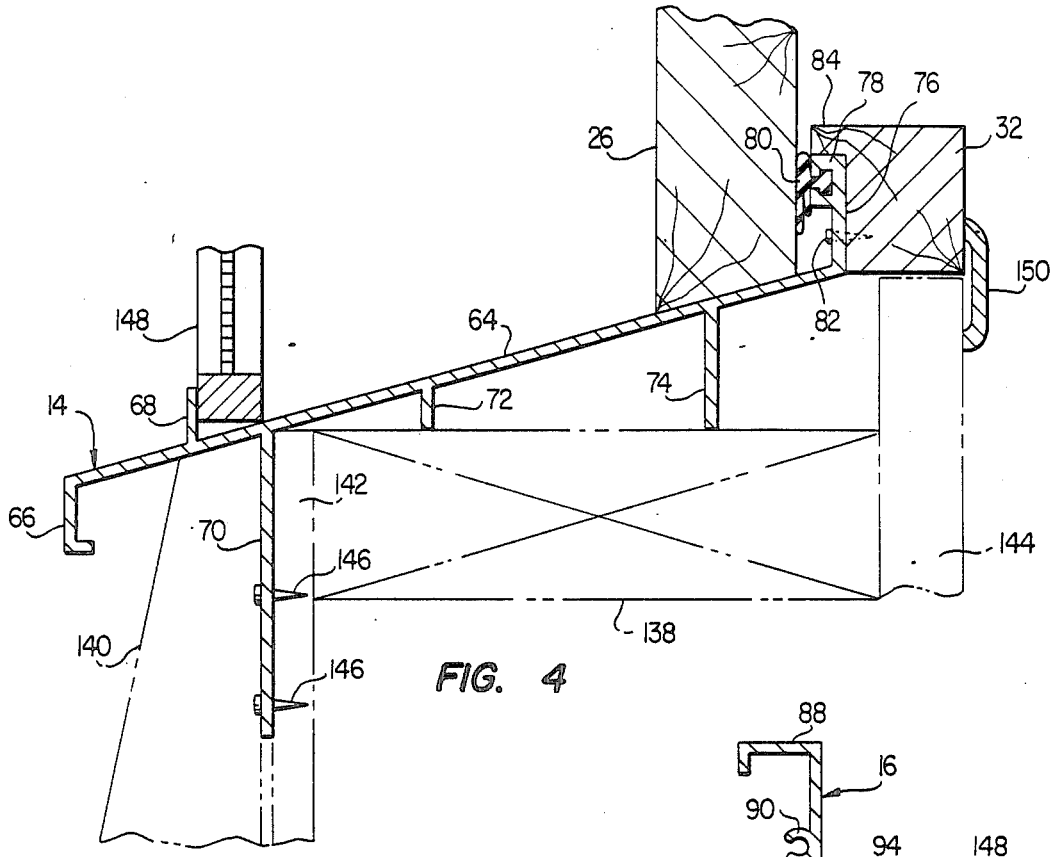
FIG. 4 is an enlarged scale cross-sectional view through a sill portion of the installed window assembly taken along line 4—4 of FIG. 2.

The sill section 14, as cross-sectionally viewed in FIG. 4, has a base portion 64 which is sloped upwardly and to the right and has formed at its left or exterior side edge a generally J-shaped portion 66. In a left-to-right sequence from portion 66, the base portion 64 also has formed thereon: a short, upwardly projecting flange 68; a much longer downwardly projecting nailing flange portion 70; a short, downwardly projecting support flange 72; a longer downwardly projecting support flange 74; and, at the right or interior side edge of base portion 64, an upturned flange 76 having at its upper end a generally C-shaped portion 78 which receives and retains along its length a portion of a flexible weatherstripping element 80. The elongated wood facing member 32 is secured to the rightwardly facing surface of the end flange 76 by means of staples 82, and has a leftwardly extending upper lip portion 84 which upwardly overlaps the end portion 78 of flange 76. Wood facing member 32 is somewhat shorter than extruded section 14, and is longitudinally centered thereon.

Figure 5:
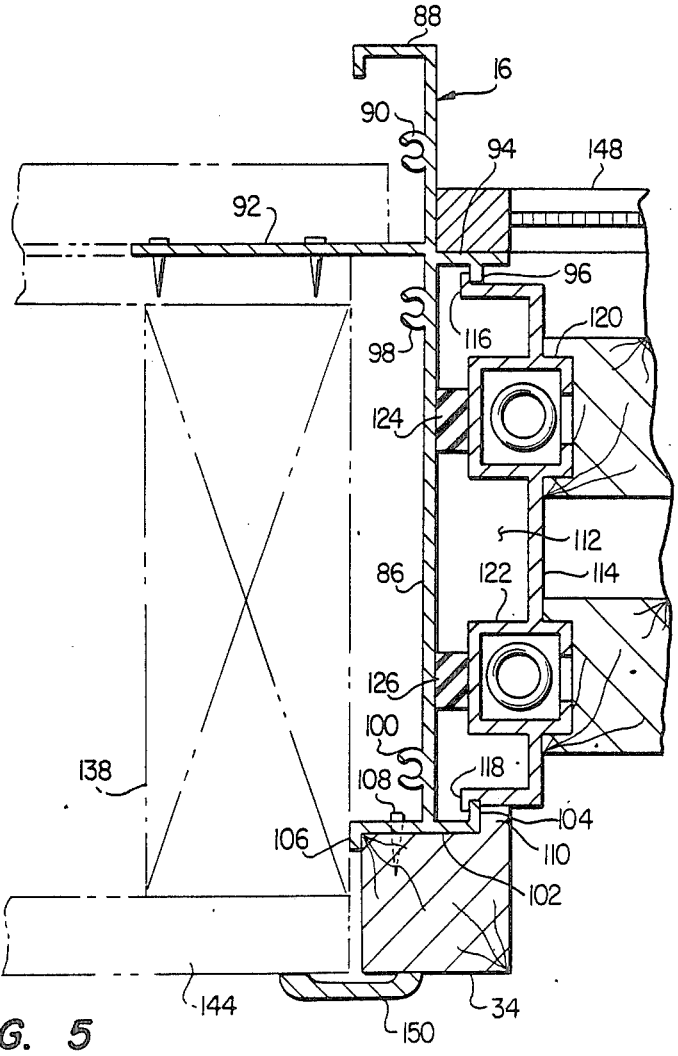
FIG. 5 is an enlarged scale cross-sectional view through a jamb portion of the installed window assembly taken along line 5—5 of FIG. 2.

As cross-sectionally viewed in FIG. 5, jamb section 16 (which is identical in configuration to jamb section 18) has a base portion 86 having formed on its top or exterior side edge a generally J-shaped portion 88. In a top-to-bottom sequence from the portion 88, the base portion 86 also has formed thereon: a leftwardly projecting, generally C-shaped screw boss 90; a leftwardly projecting nailing flange portion 92; a shorter, rightwardly projecting flange 94 having a downwardly projecting central lip 96 thereon; a pair of mutually spaced, leftwardly projecting, generally C-shaped screw bosses 98 and 100; and a perpendicular lower or interior side edge flange 102 which extends leftwardly and rightwardly of the base portion 86, the right end of flange 102 having an upwardly projecting lip 104, and the left end of flange 102 having a downwardly projecting lip 106. The elongated wood facing member 34 is secured to the downwardly facing surface of edge flange 102 by staples 108 extending downwardly through the left portion of flange 102, and has an upwardly projecting lip 110 which rightwardly overlaps the flange end 104. The elongated wood facing member 36 (FIG. 1) is secured to the right jamb section 18 in an identical manner. Wood facing members 34 and 36, respectively, extend along the entire lengths of jamb sections 16 and 18.

The lips 96, 104, together with the base portion 86 and the flanges 94, 102, define a channel 112 into which is secured a conventional plastic balance member 114. Specifically, the balance member 114, which extends along the entire length of jamb section 16, has formed thereon a pair of laterally outwardly projecting side lips 116, 118 which extend beneath and are retained by the aluminum lips 96, 104. Formed along the length of balance member 114 are a pair of generally C-shaped rectangular channels 120, 122 which have foam strips 124, 126 to resiliently press the balance member lips 116, 118 against the aluminum lips 96, 104.

Figure 6:
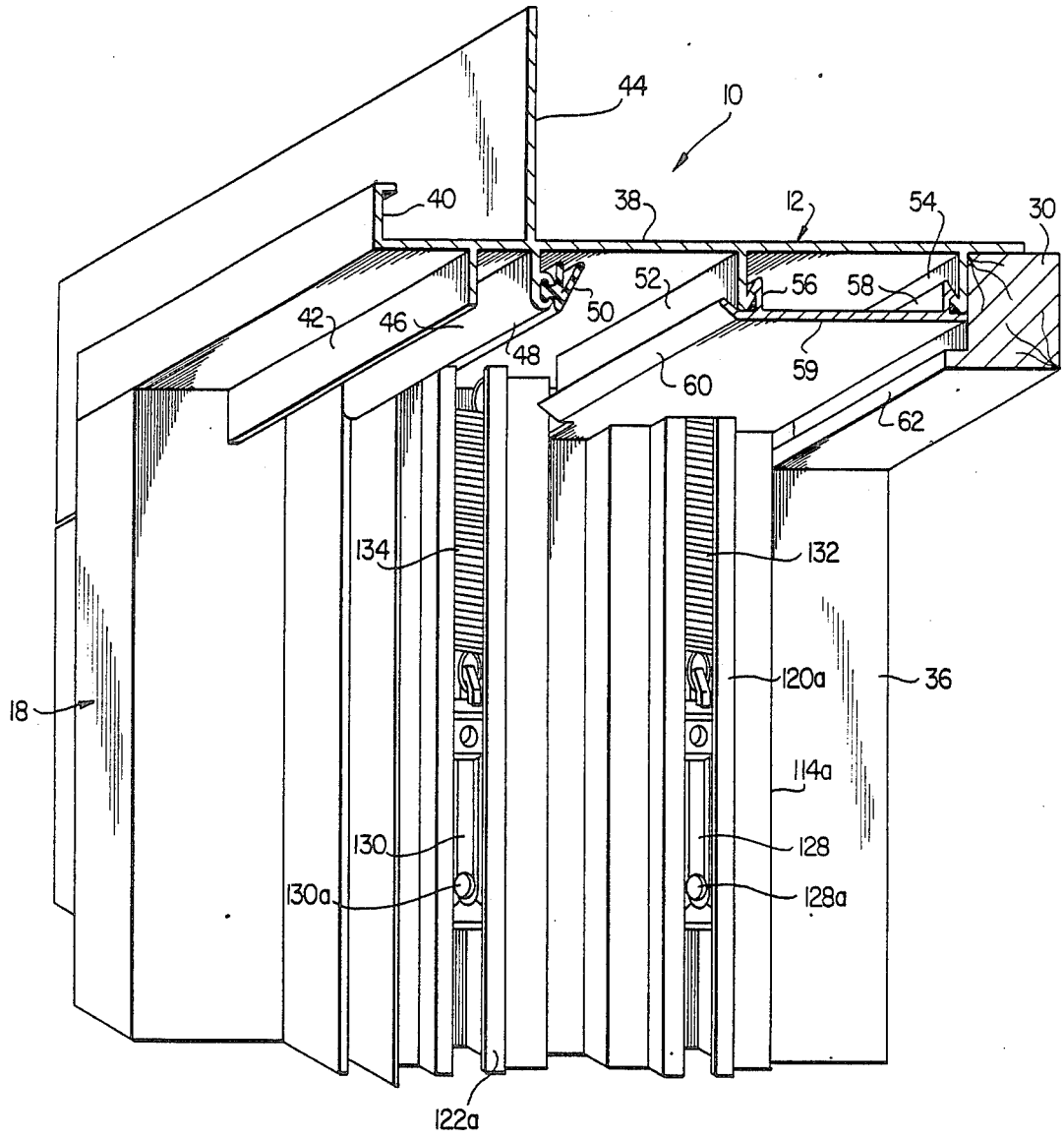
FIG. 6 is an enlarged scale perspective view of an inside, upper right corner portion of the frame of FIG. 1, after assembly thereof, and illustrates certain window assembly components carried by the frame.

As can be seen in FIG. 6, the right jamb section 18 has similarly carried therein an identical balance member $114_a$ which has corresponding rectangular channels $120_a$ and $122_a$. Like their counterpart channels 120, 122 in FIG. 5, channels $120_a$, $122_a$ slidably carry, in a conventional manner, small sash connection members 128, 130 which are spring-loaded in the channels or tracks $120_a$, $122_a$ by means of springs 132, 134. At the lower ends of connection members 128, 130 are small circular openings $128_a$, $130_a$ adapted to receive connecting pins (not shown) secured to the lower and upper window sashes 26 and 24.

The four extruded aluminum frame sections 12, 14, 16 and 18 are conveniently and inexpensively shop-fabricated, and have installed therein the various other previously described frame elements (e.g., the weather-stripping elements, the wood facing members, the sight baffle and the balances) prior to their delivery in unassembled "kit" form to the construction site. Once at the construction site, the four extruded frame sections are simply screwed together at the frame corners by means of the screws 20 which extend inwardly through appropriately positioned openings 136 formed in the upper and lower extrusion base portions 38, 64 and into the previously described screw bosses formed integrally with and extending along the lengths of the two jamb sections.

All that is then required to complete the construction of the entire window assembly 22 is to simply snap the upper and lower window sashes 24, 26 into the balance members 114, 114*a*. The completed assembly 22 is then pushed inwardly into the pre-formed window opening which is defined by the various two-by-four wood sections 138 depicted in FIGS. 3–5. The representative frame construction wall 28, prior to the installation of its exterior wood facing 140, comprises, from outside to inside, a layer of sheathing 142, the framing two-by-fours 138, and interior drywall or sheetrock facing 144.

Figure 3:
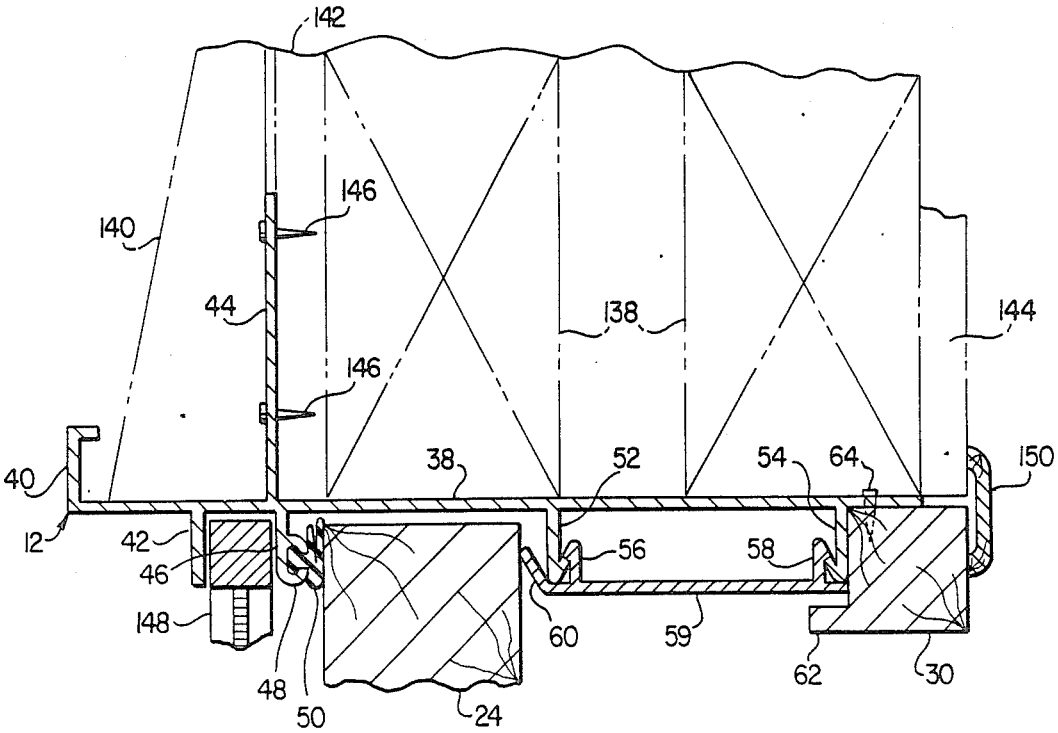
FIG. 3 is an enlarged scale cross-sectional view through a head portion of the installed window assembly taken along line 3—3 of FIG. 2.

Referring to FIGS. 3–5, it can be seen that the head, sill and jamb flanges 44, 70, and 92 collectively define around the exterior periphery of the frame an external nailing flange which is quickly and easily secured to the wall 28 by means of nails 146. This feature of the present invention completely eliminates the previous necessity (in shop-constructed wood window assemblies) to field-fabricate and install such nailing flanges. Additionally this aluminum nailing flange completely eliminates the previous necessity to field-flash the conventional wood window assembly. This is because the aluminum nailing flange also advantageously functions as a built-in flashing element which extends around the outer periphery of the installed frame 10.

In addition to the desirable benefit of its integral nailing and flashing flange, the extruded aluminum frame of the present invention also has integrally incorporated therein a variety of other structural features which, in the case of conventional all-wood "shop" window construction, must be laboriously and expensively field-fabricated and installed. In the present invention these features are automatically formed when the four frame sections are simply screwed together.

For example, it can be seen that the exterior side edge portions 40, 66, 88 (FIGS. 3–5) of the extruded frame sections collectively and automatically define in the assembled frame a J-channel which is required to receive and conceal a portion of the wood facing 140. As illustrated in FIG. 3, such J-channel also functions to provide the head section with an integral drip cap header. In the case of brick veneer exterior wall construction, this peripheral J-channel may be conveniently used as the brick mold section of the window assembly.

Also integrally formed in the assembled frame 10, by virtue of the head flanges 42, 46 and the sill flange 68, are screen-holding means which function to receive and retain the frame of a screen 148 without the previous necessity of using various clips and springs. As can be seen in FIG. 3, an upper end portion of the screen frame is retained between the head flanges 42, 46, while the lower end of the screen frame is supported between the upturned sill flange 68 and a portion of the upwardly sloping extrusion base portion 64. (FIG. 4).

The frame 10 also provides a unique labor-saving feature via the integral formation therein of the vertically extending balance channels 112. In conventional wood window frame construction it is necessary to nail or otherwise fastener-secure such balance members to the frame. However, in the present invention, no such time-consuming fastening procedure is required. Instead, the plastic balance members 114 are simply bent slightly, inserted into the channels 112 and released. Upon release, the balances snap back to their original shape, thereby automatically interengaging the balance lips 116, 118 with the undersides of the aluminum lips 96, 104 as illustrated in FIG. 5. This desirable fabricational feature also permits either or both of the balance members to be removed from the frame, for repair or replacement, without in any manner damaging the frame.

Finally, the wood facing members 30, 32, 34 and 36 which are secured to the frame sections prior to the assembly of the frame, provide the assembled frame with a rectangularly-shaped wood facing structure or "border" which, in the installed window assembly, functions to conceal the entire inner periphery of the frame from view. This unique interior wood-cladding of the extruded aluminum frame 10, which is built into the four frame sections during the simple and inexpensive shop fabrication thereof, desirably affords the installed window assembly with a very pleasing "all-wood" interior appearance. However, this aesthetically pleasing result is achieved in the present invention at a fraction of the cost of using all wood "shop" window assemblies.

As previously mentioned, the four elongated wood facing members, 30, 32, 34, 36 which are secured to the extruded aluminum frame sections and colletively define the relatively small interior wood border thereof, are essentially flush with the interior drywall section 144 of wall 28. If desired, small wood molding strips 150 (FIGS. 3–5) may be installed around the junctures of the wood facing sections and the drywall 144 to conceal any small construction gaps present therebetween. Referring to FIGS. 3 and 6, it can be seen that along the frame head section 12, the frame-concealment function of the wood facing member 30 is supplemented by the vinyl sight baffle 59 which conceals an upper frame portion extending between the wood facing element 30 and the upper sash 24.

The interior wood facing members carried by the aluminum frame sections also advantageously function as thermal dampers for the frame, impeding both summer heat gain and winter heat loss therethrough. Such wood sections accordingly offset to a significant extent the relatively high thermal conductivity of the aluminum frame.

It can be seen from the foregoing that the present invention uniquely provides a metal window frame, and a resulting window assembly, having desirable aspects of both all-metal and all-wood window construction, while eliminating or substantially reducing various of the undesirable features thereof. The pleasing interior appearance of all-wood construction is retained, but the necessity of exteriorly cladding a wood frame is totally eliminated. Additionally, the previous necessity to incure the relatively high fabrication and field installation costs of "shop" windows has been eliminated.

Finally, because of the simplicity of the frame construction described above, it is a simple matter to fabricate and inventory a large number of frame sections in widths and lengths corresponding to standard window sizes so that the appropriately sized sections can simply be pulled from inventory and delivered to the construction site in kit form for rapid frame assembly. It should additionally be noted that due to the use of standard balance members in the jamb sections of the frame, most, if not all, standard wood sashes may be utilized in the assembled frame.

The foregoing detailed description is to be clearly understood as given by way of illustration and example only, the spirit and scope of this invention being limited solely by the appended claims.

What is claimed is:

1. A wood-clad metal window frame comprising:

(a) an elongated metal head section having an interior side edge portion, a wood facing member secured to and extending along said interior side edge portion, an exterior side edge portion, and lip and flange means extending along its length;

(b) an elongated metal sill section having an interior side edge portion, a wood facing member secured to and extending along said interior side edge portion of said sill section, an exterior side edge portion, and lip and flange means extending along its length;

(c) a pair of elongated metal jamb sections each having an interior side edge portion, a wood facing member secured to and extending along said interior side edge portion of said jamb section, an exterior side edge portion, and lip and flange means extending along its length; and (d) means for intersecting said head, sill and jamb sections to thereby form an assembled essentially all- metal window frame insertable into a preformed window opening in a wall having an interior surface and an exterior surface, said assembled frame being dimensioned to extend essentially entirely through said preformed window opening when inserted thereinto and having an interior side and an exterior side, said lip and flange means defining in said assembled window frame;

(1) an integral J-channel extending completely around the exterior side periphery of said frame and adapted to peripherally inwardly receive and conceal a portion of an exterior siding material defining said exterior surface of said wall, (2) an integral, outwardly projecting nailing and flashing flange extending around the exterior side periphery of said frame inwardly adjacent said integral J-channel, and (3) an integral pair of jamb channels each defined by a spaced pair of vertically extending, peripherally inwardly projecting jamb flanges, each pair of said jamb flanges being adapted to releasably engage and retain a side edge portion of an elongated sash-supporting balance member capable of movably supporting a pair of wooden window sashes, said wood facing members collectively defining in said essentially all-metal assembled window frame an interior wood border which provides said frame with an all-wood interior appearance, and inhibits inward and outward heat flow through said frame.

2. The window frame of claim 1 wherein said head, sill and jamb sections are aluminum extrusions.

3. The window frame of claim 1 wherein said lip and flange means further define channel means on said head section, and wherein said window frame further comprises a sight baffle member carried by said channel means and concealing an interior portion of said head section.

4. The window frame of claim 3 wherein said sight baffle member has an integral weather strip element formed thereon.

5. The window frame of claim 1 wherein said lip and channel means further define on said frame a channel adapted to receive and retain a screen frame.

6. The window frame of claim 5 wherein said screen channel comprises a pair of flanges extending laterally inwardly from said heat section, and a single flange extending laterally inwardly from said sill section.

7. The window frame of claim 1 wherein said lip and flange means further define screw bosses in two of said sections, and wherein said window frame further comprises threaded fastening members extending through the other two of said sections and into said screw bosses.

8. The window frame of claim 1 wherein said J-channel is configured to additionally define along the length of said head section a drip cap header.

9. A metal-frame window assembly having an all-wood interior appearance and comprising:

(a) an essentially all-metal window frame formed from metal head, sill and jamb sections having integrally formed along their lengths lip and flange means which define in the frame an exterior peripheral J-channel extending around essentially the entire periphery of said window frame and opening laterally outwardly, an exterior peripheral nailing and flashing flange, and a pair of jams channels configured to releasably receive and retain a pair of balance members;

(b) a pair of balance members releasably retained in said jamb channels;

(c) at least one wood window sash operatively secured to said pair of balance members for movement relative to said window frame; and (d) wood facing means secured to and concealing an interior peripheral side portion of said frame, said window frame, with said wood facing means secured thereto, being insertable into a preformed window opening and dimensioned to extend along essentially the entire depth thereof.

10. The window assembly of claim 9 wherein said head, sill and jamb sections are aluminum extrusions.

11. The window assembly of claim 9 further comprising sight baffle means, carried by an integral channel portion said head section, for concealing an interior portion of said head section disposed between said wood facing means and said wood window sash.

12. The window assembly of claim 11 wherein said sight baffle means include integral weather stripping means which operatively engage said wood window sash.

13. The window assembly of claim 9 wherein said lip and flange means further define in said frame a screen channel, and wherein said window assembly further comprises a screen carried by said screen channel.

14. The window assembly of claim 9 wherein said J-channel is configured to additionally define along said head section a drip cap header.

15. An assembly kit for use in constructing an essentially all-metal window frame having an essentially all-wood interior appearance, comprising:

(a) an extruded metal head section having a wood-faced interior side edge portion;

(b) an extruded metal sill section having a wood-faced interior side edge portion;

(c) a first extruded metal jamb section having a wood-faced interior side edge portion;

(d) a second extruded metal jamb section having a wood-faced interior side edge portion; and (e) means, formed integrally with and extending along two of said sections, for operatively receiving a fastening member extended through one of the other two of said sections, said head, sill and jamb sections having means, formed integrally thereon, for collectively defining on the constructed window frame;

(1) a peripherally outwardly opening J-channel extending completely around the exterior periphery of said frame, (2) a combination nailing and flashing flange extending around said frame adjacent its exterior periphery, and (3) means for receiving and releasably retaining a pair of balance members adapted to operatively support within said frame at least one window sash, said frame being insertable into a preformed window opening in a wall and dimensioned to extend substantially completely through said window opening.

16. The assembly kit of claim 15 wherein said head, sill and jamb sections are aluminum extrusions.

17. The assembly kit of claim 15 wherein said fastening memberreceiving means are screw bosses.

18. The assembly kit of claim 17 wherein said screw bosses extend along said first and second jamb sections.

19. The assembly kit of claim 15 further comprising a pair of balance members carried by said balance member receiving means.

20. The assembly kit of claim 15 further comprising sight baffle means carried by said head section and concealing an interior portion thereof positioned between said interior side edge portion of said head section and said means for receiving and releasably retaining a pair of balance members.

21. The assembly kit of claim 20 wherein said sight baffle means have an integral weather stripping portion configured and positioned to operatively engage a window sash installed in said frame.

22. The assembly kit of claim 15 wherein said defining means further define means for receiving weather stripping element adapted to sealingly engage a window sash installed in said frame.

23. The assembly kit of claim 22 further comprising at least one weather stripping element carried by said weather stripping-receiving means.

24. The assembly kit of claim 15 wherein said defining means further define on said frame means for receiving a screen frame.

25. An essentially all-metal window frame having a substantially all-wood interior appearance, said window frame being insertable into a preformed window opening in a wall and comprising:

(a) a metal head section having integrally formed therein:

a generally J-shaped, laterally outwardly opening exterior side edge portion;

a laterally outwardly projecting nailing flange portion;

a first laterally inwardly projecting, spaced pair of flanges defining a screen-receiving channel;

an interior side edge portion;

a second laterally inwardly projecting, spaced pair of flanges positioned adjacent said interior side edge portion;

a sight baffle member carried by said second pair of flanges, concealing an interior portion of said head section, and having a weather stripping portion extending generally toward said first pair of flanges; and a wood facing member secured to said interior side edge portion;

(b) a metal, sloped sill section having integrally formed therein:

a generally J-shaped, laterally outwardly opening exterior side edge portion;

a laterally inwardly projecting screen-retaining flange;

a laterally outwardly projecting nailing flange portion;

a spaced duality of laterally outwardly projecting support flanges;

a laterally inwardly projecting flange defining an interior side edge portion of said sill section, carrying a weather stripping element, and having a wood facing member secured thereto;

(c) a pair of metal jamb sections each having integrally formed therein:

a generally J-shaped, laterally outwardly opening exterior side edge portion;

a laterally outwardly projecting nailing flange portion;

an interior edge flange having laterally outwardly and inwardly projecting portions;

a laterally inwardly projecting flange spaced from said laterally inwardly projecting portion of said interior edge flange, and defining therewith a lipped channel adapted to receive and releasably retain side edge portions of a balance member capable of movably supporting a pair of wood window sashes; and a wood facing member secured to said interior edge flange;

(d) screw bosses integrally formed in two of said metal sections; and (e) a plurality of threaded fasteners extending through the other two of said metal sections into said screw bosses, said window frame being dimensioned to extend substantially completely through said preformed window opening when inserted therein so that said wood facing strips may be positioned essentially flush with the interior surface of said wall, whereby the inserted, essentially all-metal window frame, together with wood window sashes operatively supported therein, provides the interior appearance of an all-wood window assembly.

26. The window frame of claim 25 wherein each of said metal sections is an aluminum extrusion.

27. The window frame of claim 25 wherein said screw bosses are integrally formed in said jamb sections.

28. Window frame apparatus comprising four metal frame sections having wood-clad interior side surfaces and being interconnectable to form an essentially all-metal assembled window frame insertable in assembled form into a preformed window opening in a wall having interior and exterior surfaces, the interconnected frame sections defining in the assembled frame:

an exterior peripheral nailing flange connectable to said exterior wall surface to support said assembled window frame within said preformed window opening, an exterior channel extending around the entire periphery of said assembled frame and adapted to receive and conceal a peripherally inner portion of siding material secured to said exterior wall surface and covering said nailing flange, first and second lipped flange pairs positioned on opposite peripherally inner side surfaces of said assembled frame and adapted to releasably receive and retain balance members capable of movably supporting wooden window sash elements, and a third lipped flange pair positioned on a peripherally inner upper surface of said assembled frame and adapted to releasably receive and retain a frame surface-concealing sight baffle member laterally interposed between the interior side surfaces of said assembled frame and said first and second lipped flange pairs, whereby, by operatively connecting wooden window sash elements and a sight baffle member to said assembled window frame the essentially all-metal frame may be quickly converted to a window assembly having an essentially all-wood interior appearance.

29. The window frame apparatus of claim 28 wherein:

said four metal frame sections are laterally dimensioned so that, when said assembled frame is operatively inserted into said preformed window opening, the interior side surface of said assembled frame is essentially flush with said interior wall surface.

30. The window frame apparatus of claim 29 wherein:

said four metal frame sections are aluminum extrusions.

31. The window frame apparatus of claim 30 wherein:

two of said aluminum extrusions have screw boss portions formed integrally therewith and adapted to receive threaded fastening members extended through the other two of said aluminum extrusions to thereby operatively interconnect said four aluminum extrusions.

* * * * *